United States Patent [19]

Tuhey, Jr.

[11] Patent Number: 4,834,164

[45] Date of Patent: May 30, 1989

[54] WINDOW SHADE ROLLER BRACKETS AND ASSEMBLY INCLUDING THE SAME

[75] Inventor: William Tuhey, Jr., East Meadow, N.Y.

[73] Assignee: Lynmour, Ltd., Chester, Vt.

[21] Appl. No.: 443,218

[22] Filed: Nov. 22, 1982

[51] Int. Cl.[4] ..... E06B 9/20

[52] U.S. Cl. ..... 160/319; 160/903

[58] Field of Search ..... 160/319, 320, 321, 307, 160/308, 291, 295; 188/83, 74

[56] References Cited

U.S. PATENT DOCUMENTS

| | | | |
|---|---|---|---|
| 586,745 | 7/1897 | Pierce et al. | 188/74 |
| 1,091,103 | 3/1914 | Wooton | 160/30 X |
| 3,007,342 | 11/1961 | Wardlaw | 160/291 |
| 3,854,517 | 12/1974 | Nakamura | 160/321 |
| 4,323,105 | 4/1982 | Berman et al. | 160/319 |

FOREIGN PATENT DOCUMENTS

| | | | |
|---|---|---|---|
| 2428-730 | 2/1980 | France | 160/319 |

*Primary Examiner*—Ramon S. Britts
*Assistant Examiner*—David M. Purol
*Attorney, Agent, or Firm*—Steinberg & Raskin

[57] ABSTRACT

A chain-operated window shade roller bracket and assembly including the same is disclosed wherein the bracket includes a back plate, a sprocket wheel assembly rotatably mounted thereon and a cover member affixed to the back plate. The roller is affixed to a drive shaft extension of the sprocket wheel assembly. A pressure shoe is provided which may be actuated to provide the roller with a selectively variable resistance to rotation or to lock the roller in position.

8 Claims, 2 Drawing Sheets

FIG. 3
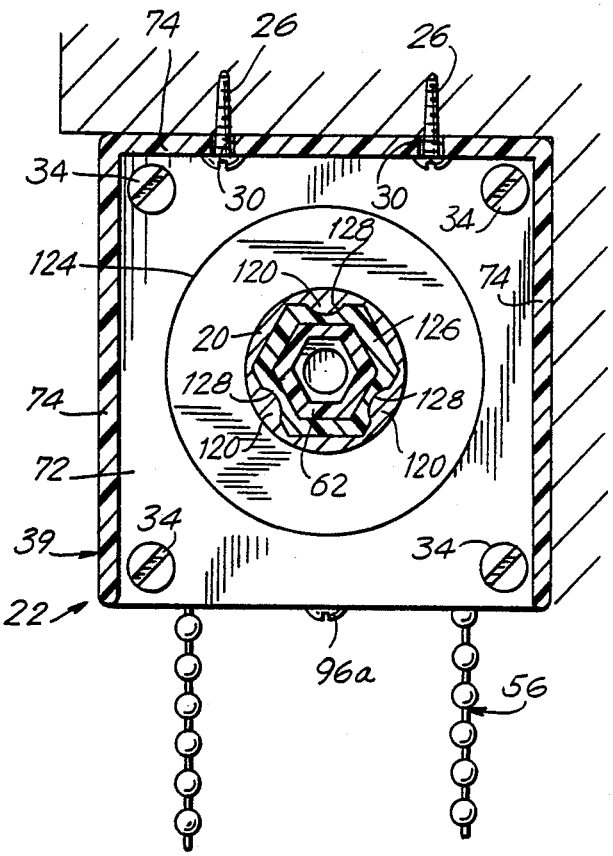
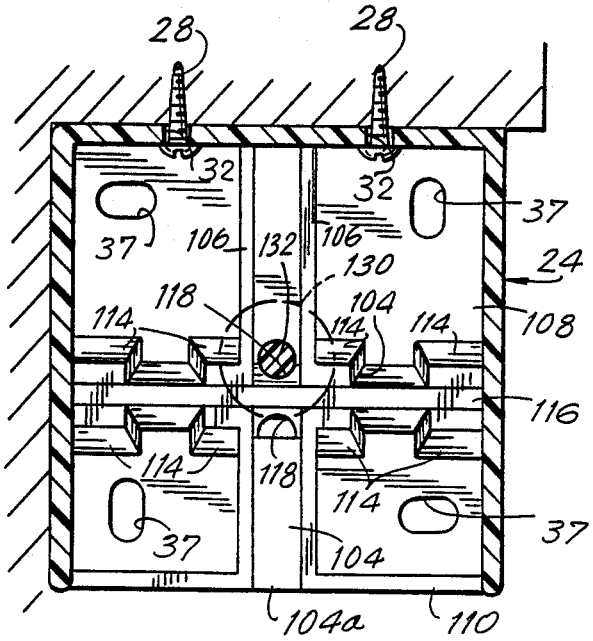
FIG. 4

WINDOW SHADE ROLLER BRACKETS AND ASSEMBLY INCLUDING THE SAME

BACKGROUND OF THE INVENTION

The present invention relates generally to window shade apparatus and, more particularly, to brackets for mounting a window shade roller around which a shade is wound and unwound by a chain mechanism, and assemblies including the same.

Brackets for rotatably mounting chain-operated window shade rollers of the prior art are constructed according to several diverse arrangements. However, many of such constructions strive to achieve several or all of the same objectives. Thus, it is desirable for the brackets to provide a secure mounting of the shade roller while at the same time providing a relatively free and easy winding and unwinding rotation thereof. It would also be desirable to provide such brackets with a feature whereby the resistance to rotation of the roller can be selectively varied even to a degree whereby the roller can be locked in position with the shade in a wound, unwound, or partially wound condition. Other objectives of window shade roller brackets is that the same be relatively uncomplicated in construction and easy to install.

SUMMARY OF THE INVENTION

Accordingly, it is an object of the present invention to provide new and improved window shade roller brackets and assemblies including the same.

Another object of the present invention is to provide new and improved window shade roller brackets which provide a secure mounting of the shade roller while at the same time providing a relatively free and easy winding and unwinding rotation thereof.

Still another object of the present invention is to provide new and improved window shade roller brackets provided with a feature whereby the resistance to rotation of the roller can be selectively varied and whereby the roller can be locked in position when desired.

Yet another object of the present invention is to provide a new and improved window shade roller bracket which is relatively uncomplicated in construction and which facilitates installations of the roller shade assembly.

Briefly, in accordance with the present invention, these and other objects are obtained by providing a chain-operated window shade roller bracket and assembly, the bracket including a back plate, a sprocket wheel assembly mounted thereon and a cover member affixed to the back plate. The roller is affixed to a drive shaft extension of the sprocket wheel assembly. A pressure shoe is provided which may be actuated to provide the roller with selectively variable resistance to rotation or to lock the roller in position. Other features and advantages of the invention will be apparent from the following description.

DESCRIPTION OF THE DRAWINGS

A more complete appreciation of the present invention and many of the attendant advantages thereof will be readily understood by reference to the following detailed description when considered in connection with the accompanying drawings in which:

FIG. 3 is a section view taken along line 3—3 of FIG. 1; and

FIG. 4 is a section view taken along line 4—4 of FIG. 1.

DESCRIPTION OF THE PREFERRED EMBODIMENTS

Figure 1:
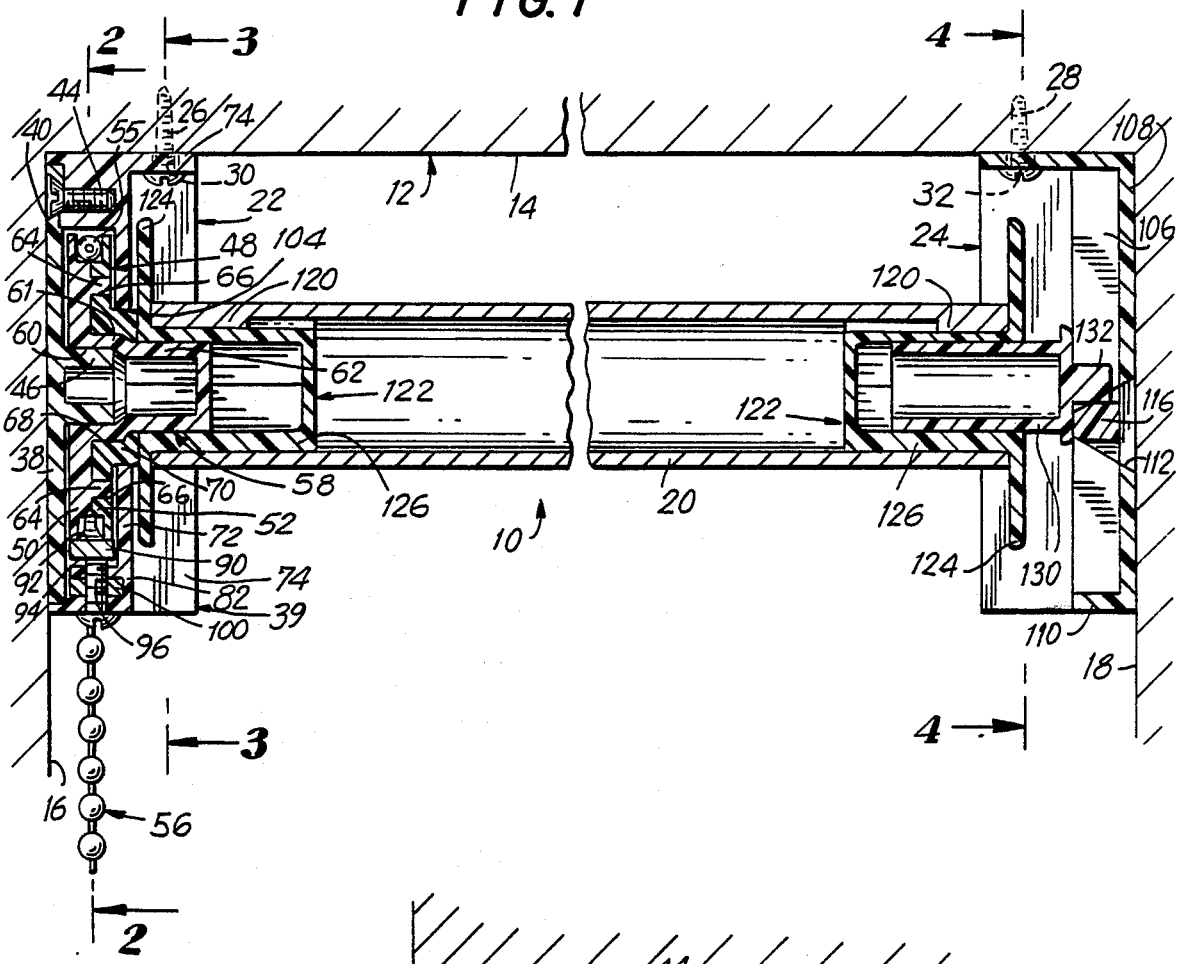
FIG. 1 is a side elevation view in section of a window shade roller assembly according to the present invention incorporating brackets for mounting the roller according to the present invention.

Referring now to the drawings wherein like reference characters designate identical or corresponding parts throughout the several views, and more particularly to FIG. 1, a window shade bracket assembly in accordance with the present invention, generally designated 10, is illustrated installed within a window frame 12 defined by an upper wall 14 and side walls 16 and 18. However, it is understood that the assembly 10 can be mounted to a ceiling or other walls, installation in a window frame not being essential to the present invention.

The assembly 10 includes a shade roller 20, over which a shade (not shown) is wound, mounted at its ends to respective brackets, generally designated 22 and 24, in a manner described hereinbelow. The brackets 22 and 24 are fixed to the upper wall 14 by means of pairs of screws 26 and 28 (FIGS. 3 and 4) passing through respective openings 30 and 32 formed in the brackets. At least bracket 22 is fixed to the side wall 16 by four screws 34 passing through openings 36 of bracket 22 and it is understood that bracket 24 may be similarly mounted on side wall 18 by screws passing through openings 37.

The construction and operation of bracket 22 will now be described. Unless otherwise noted, all of the components of bracket 22, except for screws, nuts and the like, are preferably formed by conventional injection molding techniques of any suitable rigid plastic material.

A back plate 38 has a rectangular and preferably square outer configuration. A hole is formed through the back plate 38 in each of its four corner regions which, when aligned with holes formed in a cover member 39, described below, define the openings 36 through which screws 34 pass for attachment of the bracket to the side wall 16. Moreover, three countersunk holes 40 (only one shown in FIG. 1) are formed through the back plate which align with three corresponding internally threaded blind bores 42 (FIG. 2) formed in the cover member 39. As described below, the cover member 39 is so positioned on back plate 38 so that respective holes 40 and bores 42 become aligned to receive screws 44 to thereby rigidly connect the back plate and cover member together. The heads of screws 44 are received in the countersunk portion of back plate 38 as seen in FIG. 1 to allow a flush mounting of the bracket 22.

A stub shaft 46 is integrally molded in back plate 38 and extends from a central region thereof for a limited distance. The stub shaft 46 functions to rotatably support a sprocket wheel assembly 48 as described in greater detail hereinbelow.

Figure 2:
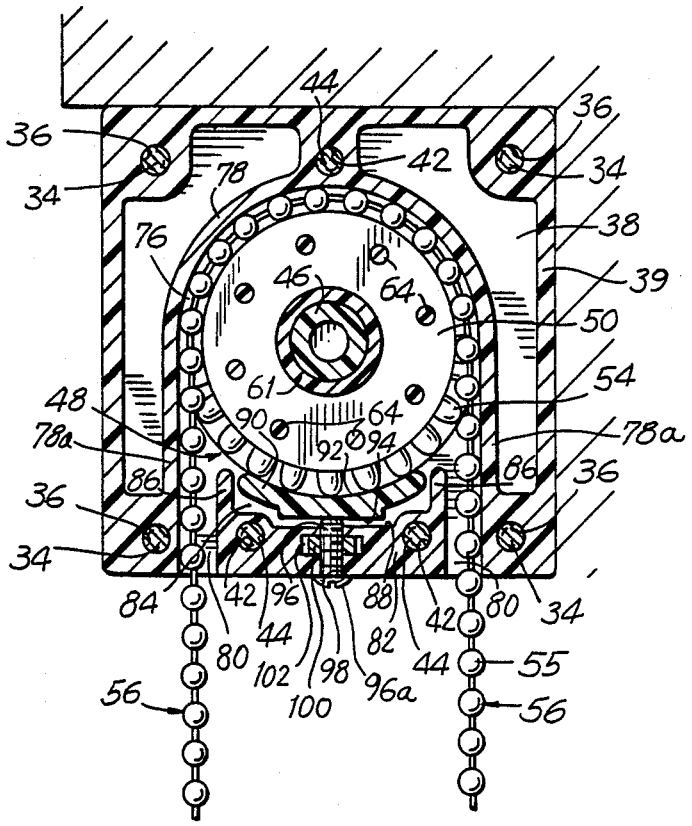
FIG. 2 is a section view taken along line 2—2 of FIG. 1.

A sprocket wheel assembly 48 is constituted by a drive wheel part 50 interconnected to a retaining wheel part 52 in a manner so as to be rotatably fixed with respect thereto. The drive wheel part 50 has a circular outer configuration having a plurality of depressions 54 formed along the periphery thereof, each of which is adapted to be positioned in opposition to one of a plurality of similar depressions formed along the periphery of the retaining wheel part 52 to form an open cavity to receive a bead 55 of a flexible member means, i.e., a bead chain 56 as seen in FIGS. 1 and 2. The depressions are formed and spaced from each other in a conventional manner so that as the chain 56 is pulled in a particular direction, successive beads 55 of chain 56 received in successive cavities of a sector of the sprocket wheel assembly as the sprocket wheel assembly rotates on stub shaft 46.

A drive shaft 58 is integrally molded in the drive wheel part 50 and extends therefrom coaxially with the axis of rotation thereof. The drive shaft 58 has a hollow interior terminating at an externally opening cylindrical bore 60 having an inner diameter substantially equal to but slightly greater than the outer diameter of stub shaft 46. The drive wheel part 50 is rotatably mounted on stub shaft 46 by inserting stub shaft 46 into the cylindrical bore 60. The drive shaft includes an inner cylindrical portion 61 which merges with an outer drive shaft extension 62 having a hexagonal cross-section (FIG. 3).

A plurality of projections 64 are molded in the drive wheel part 50 inwardly of depressions 54 in a circular configuration substantially equally spaced from each other. The projections 64 serve to properly align the disc wheel part 50 and retaining wheel part 52 when the same are interconnected to each other.

The retaining wheel part 52 has the same circular outer configuration as drive wheel part 50 and has a plurality of depressions formed about the periphery thereof as noted above. A plurality of openings 66 (only two shown in FIG. 1) are formed through the retaining wheel part 52 adapted to align with and receive the projections 64 of drive wheel part 50. A central cylindrical opening 68 formed in retaining wheel part 52 has an inner diameter substantially the same as the outer diameter of the inner cylindrical portion 61 of drive shaft 58 so as to be receivable thereof when the drive and retaining parts are interconnected. An annular shoulder 70 surrounds opening 66 and defines a hexagonal opening extension adapted to receive the innermost region of drive shaft extension 62. It will be seen from the foregoing that the drive wheel part 50 and retaining wheel part 52 can be rigidly interconnected by passing the drive shaft 58 of the former through the opening 68 of the latter with projections 64 being inserted into openings 66 to form the sprocket wheel assembly 48. The drive shaft extension 62 extends a distance beyond the shoulder 70 of retaining wheel part 52. The sprocket wheel assembly 48 is rotatably mounted on the stub shaft 46 as described above.

Referring now to the cover member 39 of bracket 22, the same is constituted by a plate 72 having the same outer configuration as back plate 38. A peripheral flange 74 extends outwardly from plate 72 along three of the four edges thereof, the flange being omitted from the lower edge of plate 72 as seen in FIG. 3. Four hole are formed through the corner regions of plate 72 which are aligned with corresponding holes formed in the back plate 38 so as to define the openings 36 through which screws 34 pass. Moreover, three blind internally threaded bores 42 are formed in plate 72 which are adapted to receive screws 44 as described above in connection with the fastening of the cover member 39 to back plate 38.

Referring to FIG. 2, a recess 76 is formed in plate 72 which is adapted to receive the sprocket wheel assembly 48 when the latter is mounted on stub shaft 46 and the cover member is affixed to back plate 38. The recess 76 is defined by a semi-cylindrical wall 78 which has tangential portions **78*a* which extend to the lower edge of plate 72. The tangential portions 78*a* of wall 78 define a pair of channels 80 with a shoe-retaining portion 82 of plate 72. The channels 80 provide passageways through which the bead chain 56 passes as seen in FIG. 2. The shoe-retaining portion 82 is formed by appropriately recessing the plate 72 to form a sub-space 84 between a pair of retaining walls 86 and a lower surface 88 thereof. As described below in greater detail, a pressure shoe 90 is loosely located in the sub-space 84 to provide a selectively variable pressure on a lower segment of the sprocket wheel assembly 48 so that the resistance to rotation of the roller 20** can be selectively varied and whereby the roller can be locked in a particular position when desired.

As noted above, it is often desirable to provide a window shade roller assembly with a capability whereby the resistance to rotation of the roller can be selectively varied and, moreover, to provide the ability to lock the roller in a particular position with the shade being wound or unwound to a desired extent. It is also desirable to provide such a selective variation and locking feature in a manner such that adjustments and actuation thereof can be accomplished quickly and in a simple manner with no complicated maneuvers being required.

In accordance with the present invention, a pressure shoe 90 is situated in a loose manner within the sub-space 84 defined between the retaining walls 86 and lower surface 88 of the shoe retaining portion 82, the lower segment of the sprocket wheel assembly 48 and the opposed region of back plate 38. The pressure shoe 90 has an arcuate pressure surface 92 having the same radius of curvature as that of the outer perimeter of sprocket wheel assembly 48 and extends substantially over the entire transverse distance between retaining walls 86, a small clearance being provided at each end as seen in FIG. 2. The lower surface 94 of the pressure shoe 90 has a planar configuration adapted to engage the lower surface 88 of sub-space 84 presented by the shoe retaining portion 82 of cover member 39. The dimensions of the space 84 and pressure shoe 90 are selected such that when the lower surface 94 of shoe 90 engages the lower surface 88 of space 84, the pressure surface 92 of the shoe will be spaced and therefore disengaged from the opposed segment or sector of the sprocket wheel assembly 48.

A screw 96 extends through a bore 98 formed in the shoe retaining portion 82 of cover member 39 and is held therein by means of a nut 100 threaded thereon which is situated within a recess 102 formed in portion 82. The head **96*a* of screw 96 is thereby situated externally of the bracket 22 facing downwardly. It will be readily appreciated from the foregoing that by rotating the screw in a tightening direction with the nut being held stationary within the recess 102, the inner end of the screw will move inwardly and upwardly within the sub-space 84 and abut the lower surface of shoe 90 as shown in FIGS. 1 and 2. Continued rotation of screw 96 will result in upward movement of shoe 90 until the arcuate pressure surface 92 thereof engages a sector of the perimeter of sprocket wheel assembly 48. The pressure with which the shoe engages the sprocket wheel assembly is determined by the position of screw 96 and can be selectively varied by suitable rotation of the screw. Indeed, the sprocket wheel assembly 48 can be rotatably locked on the stub shaft 46 by tightening the screw 96 to an extent such that the shoe 90 bears against the sprocket wheel assembly with a pressure which will prevent its rotation regardless of the tension applied to the bead chain 56. It is clearly seen in FIG. 2 that the sector of the sprocket wheel assembly which is engaged by the pressure shoe is positioned between the bead chain channels 80** so that the bead chain cannot engage the sprocket wheel assembly along this sector.

The cover member 39 is provided with a central circular opening 104 having a diameter substantially equal to the outer diameter of the annular shoulder 70 so as to be receivable thereof during assembly as described below.

In the assembly of bracket 22, the drive wheel part 50 is positioned on the back plate 38 so that the stub shaft 46 is received within the cylindrical bore 60 of the inner cylindrical portion 61 of the drive shaft 58. The retaining wheel part 52 is then positioned on the drive wheel part 50 with the drive shaft extension 62 of the drive wheel part extending through the opening 68 in the retaining wheel part to form the sprocket wheel assembly 48. The pins or projections 64 are received in openings 66 to insure proper alignment of the two parts. The bead chain 56 is then fitted in the sprocket wheel assembly 48 with successive beads 55 being removably received in successive cavities. With the pressure shoe 90, nut 100 and screw 96 already properly positioned in the cover member 39 as described above, the latter is fitted to the back plate 38 with the central opening 104 receiving the annular shoulder 70 and taking care that portions of the bead chain extend through the channels 80. The screws 34 are then inserted in openings 36 and tightened to secure the assembly.

It will be seen that when one end of the chain 56 is pulled the sprocket wheel assembly will rotate in a particular direction with the drive shaft extension 62 projecting through the openings 68 and 104. As described below, the roller 20 is rotated by suitable connection of a first one of its ends to the drive shaft extension 62.

The bracket 24 comprises an idler bracket which is adapted to mount the second end of roller 20 in position after its first ed has been connected to the drive shaft extension 62 of drive bracket 24. Idler bracket 24 is formed with a vertically extending channel 104 defined by a pair of parallel rails 106 integrally molded with and extending from a planar end wall 108 thereof. The channel 104 externally opens at its lower end **104*a* through a lower flange 110. A horizontally extending slot 112 having a truncated triangular cross-section intersects the vertical channel 104 and is defined by pairs of inwardly converging flanges 114. A slide 116 having a corresponding cross-section is removably positioned within slot 112, the slide having a pair of concave bearing depressions 118** centrally formed in opposed surfaces thereof.

The mounting of the roller 20 on drive and idler brackets 22 and 24 will now be described. In the illustrated embodiment, the roller 20 comprises a conventional hollow cylindrical roller having end portions, each of whose interior surfaces are formed with fluting in the nature of three equally spaced ribs 120 axially extending for a limited distance from the end edge of the roller towards its center. A pair of identical end caps 122 are associated with respective ends of the roller 20. More particularly, each end cap 122 includes a circular flange 124 from which a hollow shaft 126 projects. As best seen in FIG. 3, the shaft 126 has a cross-section which is hexagonal in outer configuration with three equally spaced channels 128 being formed in respective faces thereof. Moreover, the hollow interior of shaft 126 is hexagonal in cross-section, having a configuration which corresponds to that of the drive shaft extension 62.

To mount the first end of roller 20 to the drive bracket 22, the shaft 126 of end cap 122 is inserted into the interior of the roller with ribs 120 being received in channels 128. The drive shaft extension 62 is then inserted into the hollow bore of shaft 126. It will be seen that the end cap 122 is thus constrained to rotate with the drive shaft extension 62 and in turn the roller 20 is constrained to rotate with the end cap 122.

In order to mount the second end of roller 20 to the idler bracket 24, an end cap 122 is similarly inserted into the interior of the roller. A plug 130 having a hexagonal cross-section shaft and a pin 132 is inserted into the cap 122 as seen in FIG. 2. The slide 116 is removed from slot 112 whereupon the second end of the roller with the associated end cap and plug is raised with pin 132 being received in the vertical channel 104 of bracket 24. When the pin 132 has been situated vertically above the slot 112, the slide 116 is repositioned with a bearing depression 118 located in the slot whereupon the roller is positioned such that the pin 132 is supported thereon.

It is apparent from the foregoing that a window shade roller bracket and assembly is provided in accordance with the invention whereby the shade roller can be securely mounted in position while at the same time provides a relatively free and easy winding and unwinding rotation thereof. Moreover, the resistance of the roller to rotation can be selectively varied and the roller locked in position when desired. Such selective variation of the resistance of the roller to rotation can be easily varied through suitable rotation of the screw 96. This is an easy maneuver in that the head **96*a* of the screw is conveniently located so as to face downwardly from the bracket 22** so that it is an easy operation for a person to rotate the screw using a screw driver or similar tool. The apparatus is relatively simple in construction being substantially entirely formed of molded plastic pieces and conventional screws and the like. The fact that the pressure shoe is loosely held within the bracket further simplifies the construction of the bracket relative to prior art apparatus.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A window shade roller bracket comprising:

a back plate having a stub shaft extending therefrom;

a sprocket wheel assembly rotatably mounted on said stub shaft, said sprocket wheel assembly having a drive shaft extension projecting outwardly coaxially with the axis of rotation of said sprocket wheel assembly, said sprocket wheel assembly being formed along the periphery thereof with means for engaging a portion of an elongate flexible member;

a cover member affixed to said back plate to define a substantially closed interior space therewithin within which said sprocket wheel assembly is enclosed, said cover member having an opening formed therein through which said drive shaft extension passes;

said back plate and cover member together defining a pair of passages, each passage intercommunicating said interior space defined between said back plate and said cover member and a space external of said shade roller bracket with regions of said flexible member situated laterally of said flexible member portion which engages said flexible member engaging means of said sprocket wheel assembly passing from within said interior space to a space external thereof such that a first sector of the sprocket wheel assembly periphery at all times remains free of the elongate flexible member while a second sector of the sprocket wheel assembly periphery is at all times engaged by a portion of the elongate flexible member;

a retaining portion formed on at least one of said back plate and cover member, said retaining portion together with said back plate, said cover member and said first sector of said sprocket wheel assembly periphery together defining a sub-space within said substantially closed interior space between said back plate and cover member for receiving pressure means;

pressure means situated in said pressure receiving sub-space, pressure means having a pressure surface situated in opposed relationship to said first sector of said sprocket wheel assembly periphery; and means extending between said pressure means receiving sub-space and a region radially external of said closed interior space for selectively urging said pressure surface of said pressure means against said first sector of the sprocket wheel assembly periphery, said urging means being actuatable from said region radially external of said closed interior space.

2. The combination of claim 1 wherein said sprocket wheel assembly includes a drive wheel part in which said drive shaft extension is formed and a retaining wheel part adapted to be rotatably fixed to said drive wheel part, said retaining wheel part having an opening formed therein through which said drive shaft extension passes.

3. The combination of claim 1 wherein said flexible member means comprise a bead chain and wherein said sprocket wheel assembly includes a plurality of depressions formed around the periphery thereof, the depressions in said second sector of said sprocket wheel assembly adapted to successively receive the beads of said bead chain while the depressions in said first sector of said sprocket wheel assembly remain at all times devoid of such beads.

4. The combination of claim 1 wherein said means for urging said pressure surface of said pressure means against said first sector of the periphery of said sprocket wheel assembly includes a threaded member passing through said retaining portion and engaging said pressure means, said threaded member having a portion extending externally of said interior space.

5. The combination of claim 4 wherein said pressure means is situated loosely within said receiving sub-space and wherein one end of said threaded member abuts said pressure means so that upon rotation of said threaded member in one direction, said pressure means is pushed by said threaded member towards said sprocket wheel assembly, and upon rotation of said threaded member in another direction, said pressure means moves away from said sprocket wheel means under the force of gravity.

6. The combination of claim 6 wherein a recess is formed in said retaining portion, and further including an internally threaded member situated in said recess, said internally threaded member being substantially fixed in said recess when said cover member and back plate are fixed to each other, said threaded member threadedly engaging said internally threaded member.

7. The combination of claim 4 wherein said retaining portion includes a pair of spaced retaining walls between which said pressure means is situated, said retaining walls retaining said pressure means in said pressure means receiving sub-space.

8. The combination of claim 7 wherein said retaining walls at least partially define said pair of channels, each channel opening externally from said interior space, said channels receiving respective portions of flexible member means for rotatably driving said sprocket wheel assembly.

* * * * *